US008928546B1

(12) United States Patent
Eubanks et al.

(10) Patent No.: US 8,928,546 B1
(45) Date of Patent: Jan. 6, 2015

(54) ULTRA-WIDEBAND, OMNI-DIRECTIONAL, LOW DISTORTION COAXIAL ANTENNA

(75) Inventors: Travis Wayne Eubanks, Albuquerque, NM (US); Christopher Lawrence Gibson, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 295 days.

(21) Appl. No.: 13/464,056

(22) Filed: May 4, 2012

(51) Int. Cl.
*H01Q 13/10* (2006.01)

(52) U.S. Cl.
USPC ..... 343/773; 343/772; 343/786

(58) Field of Classification Search
None
See application file for complete search history.

(56) References Cited

U.S. PATENT DOCUMENTS 2,454,786 A 11/1948 Briliouin
7,027,004 B2 * 4/2006 Haunberger et al. ..... 343/790
7,286,095 B2 * 10/2007 Parsche et al. ..... 343/773
7,525,501 B2 * 4/2009 Black et al. ..... 343/773
8,068,065 B1 * 11/2011 Struckman ..... 343/792.5
8,884,832 B2 * 11/2014 Huang et al. ..... 343/773
2006/0250315 A1 * 11/2006 Parsche ..... 343/773
2007/0115194 A1 * 5/2007 Song et al. ..... 343/773

* cited by examiner

*Primary Examiner* — Trinh Dinh
(74) *Attorney, Agent, or Firm* — Scott B. Stahl

(57) ABSTRACT

An antenna for producing an omni-directional pattern, and using all frequencies of a frequency range simultaneously, is provided with first and second electrically conductive elements disposed coaxially relative to a central axis. The first element has a first surface of revolution about the axis, the first surface of revolution tapering radially outwardly while extending axially away from the second element to terminate at a first axial end of the first element. The second element has a second surface of revolution about the axis, the second surface of revolution tapering radially outwardly while extending axially toward the first element to terminate at a first axial end of the second element. The first and second surfaces of revolution overlap one another radially and axially, and are mutually non-conformal.

19 Claims, 5 Drawing Sheets

ULTRA-WIDEBAND, OMNI-DIRECTIONAL, LOW DISTORTION COAXIAL ANTENNA

This invention was developed under Contract DE-AC04-94AL85000 between Sandia Corporation and the U.S. Department of Energy. The U.S. Government has certain rights in this invention.

FIELD

The present work relates generally to omni-directional ultra-wideband antennas and, more particularly, to antennas capable of using the entire available spectrum simultaneously.

BACKGROUND

Ultra-Wideband (UWB) communication systems operate in the 3.1-10.6 GHz portion of the frequency spectrum, as allocated by the Federal Communication Commission. A system that is able to use the entire UWB bandwidth simultaneously can achieve extremely high data rates, or tolerate ultra-low power transmissions. The aforementioned extremely high data rates are of course desirable for any communication system, for example, a wireless local area network (LAN). The aforementioned ultra-low power transmissions are useful in applications such as multiple-radio undetectable communications, for example, ultra-low power frequency spreading systems.

Conventional UWB antennas provide omni-directional patterns, and can use the entire UWB spectrum simultaneously. One conventional example of a wideband omni-directional antenna is a planar UWB monopole, realized as a triangular shape above a ground plane. However, the conventional UWB antennas exhibit unwanted levels of phase distortion in their transmission and reception capabilities.

It is desirable in view of the foregoing to provide a UWB antenna that produces an omni-directional pattern, maintains gain at useful levels throughout the pattern, uses the entire UWB spectrum simultaneously, and exhibits a lower level of phase distortion than conventional antennas.

DETAILED DESCRIPTION

Figure 1:
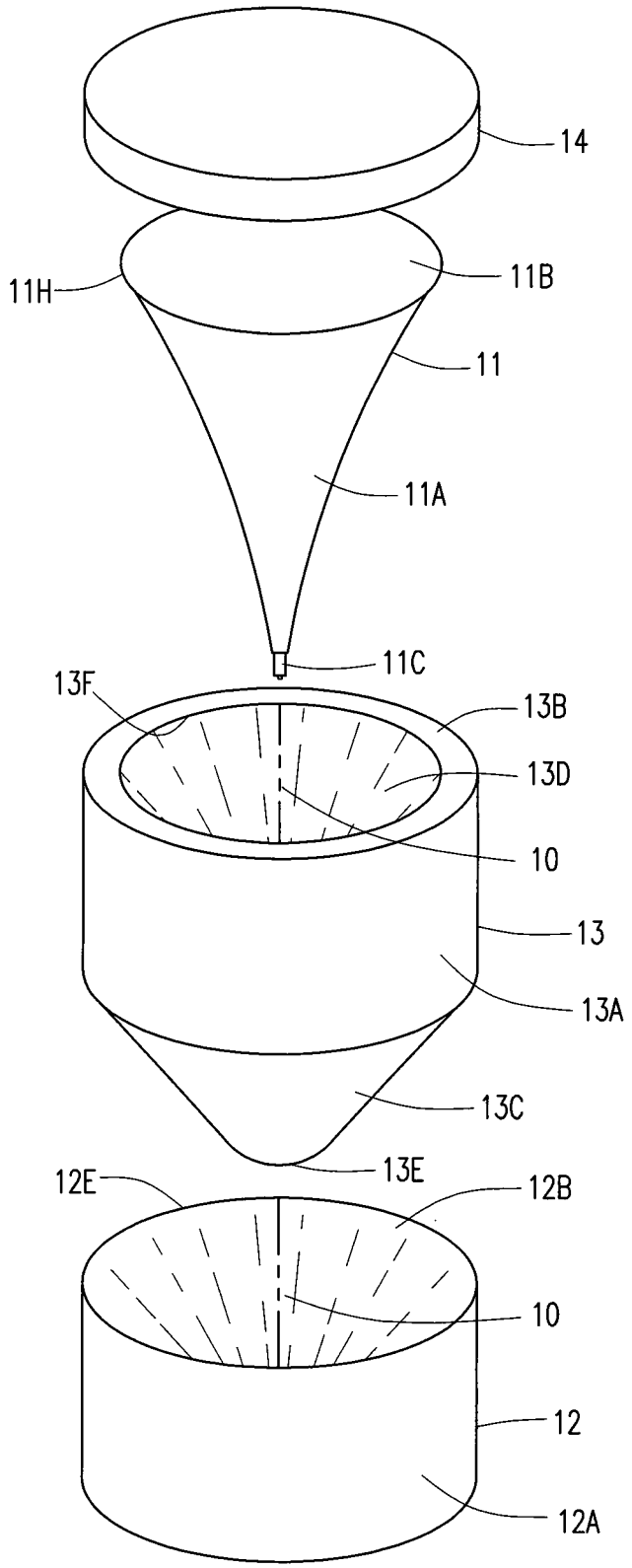
FIG. 1 is an exploded view of the components of an antenna according to example embodiments of the present work.

FIG. 1 is an exploded view of the components of an antenna according to example embodiments of the present work. The antenna components 11-14 are coaxially aligned relative to a central axis shown at 10. A first conductive element 11 is received within a central opening 13F within an annular dielectric core element 13. The dielectric core element 13 is in turn received within a second, annular conductive element 12. A radially outwardly facing tapered surface 13C of the dielectric core element 13 seats against a radially inwardly facing tapered surface 12B of the second conductive element 12. A radially outwardly facing tapered surface 11A of the first conductive element 11 seats against a radially inwardly facing tapered surface 13D of the dielectric core element 13.

Figure 2:
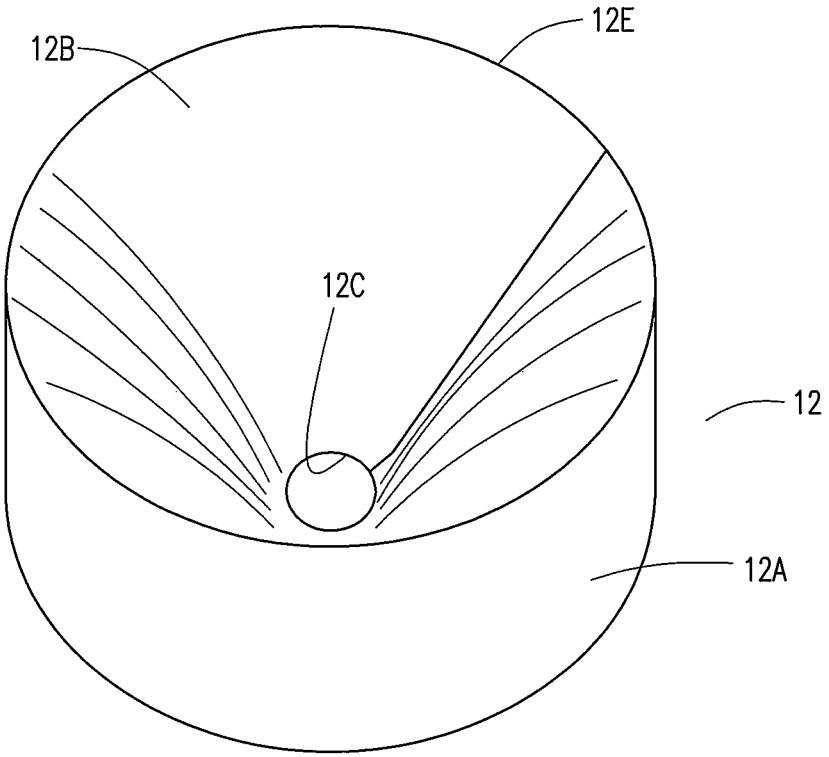
FIGS. 2 and 3 illustrate features of the annular conductive element of FIG. 1 according to example embodiments of the present work.
Figure 6:
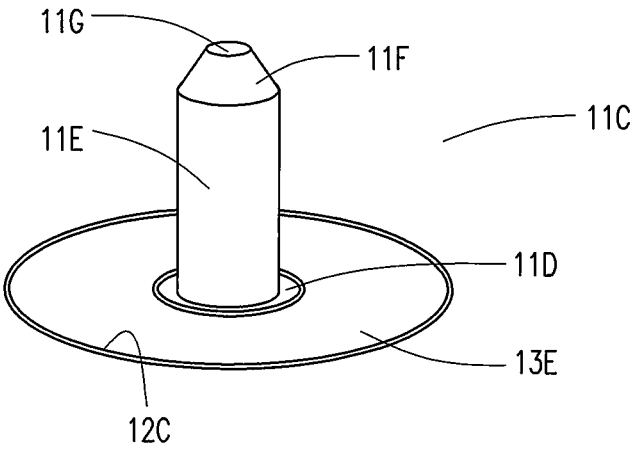
FIGS. 6 and 7 illustrate features of the assembled antenna of FIG. 5 according to example embodiments of the present work.
Figure 3:
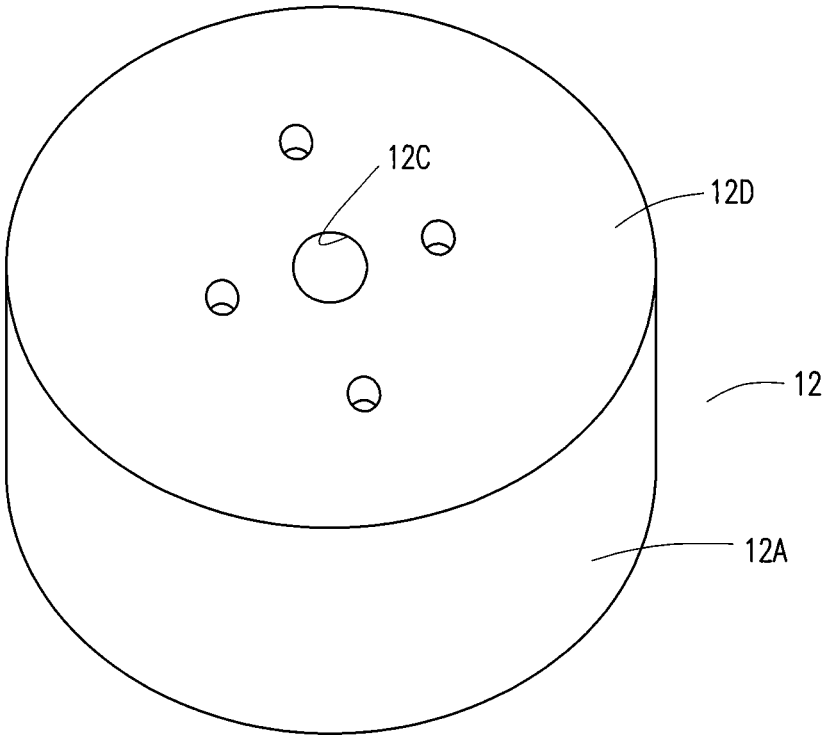
Figure 4:
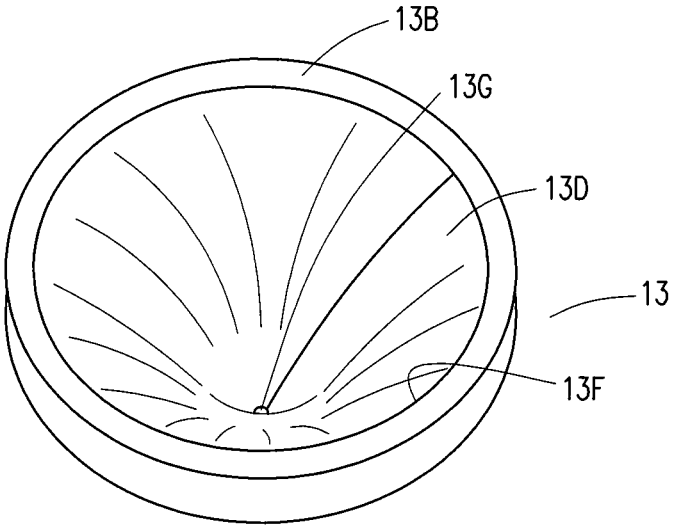
FIG. 4 illustrates features of the dielectric core of FIG. 1 according to example embodiments of the present work.
Figure 5:
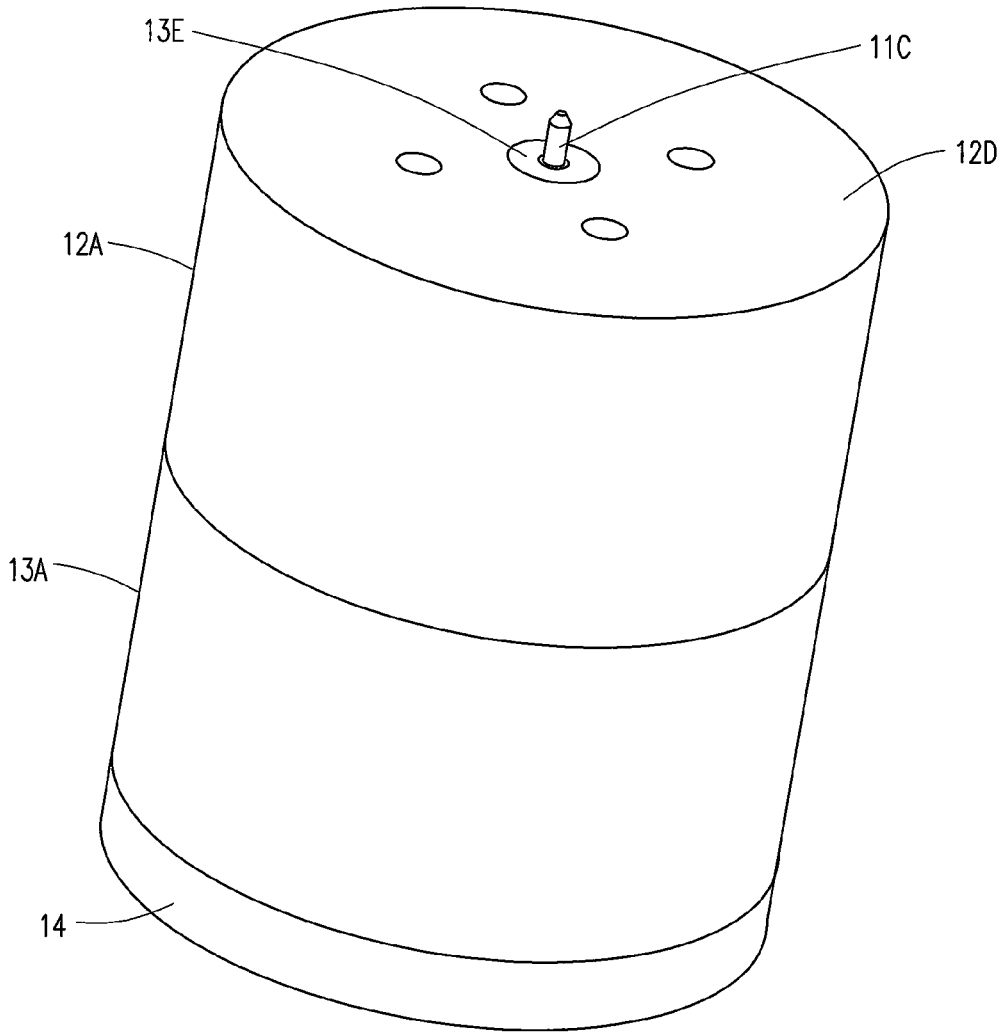
FIG. 5 illustrates an antenna assembled from the components of FIG. 1.
Figure 7:
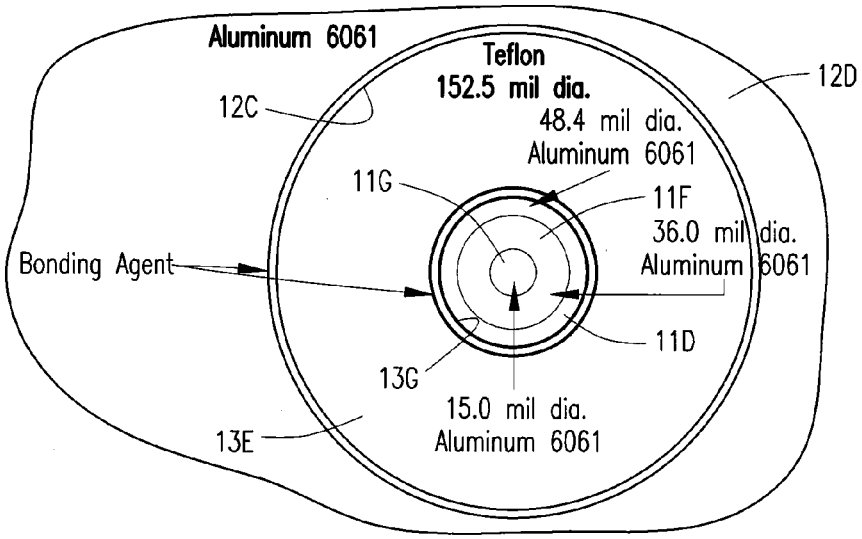

Referring now to FIG. 4, the dielectric core 13 has a central opening 13G in an end surface 13E thereof (see also FIGS. 1, 6 and 7) axially opposite the central opening 13F. Referring also to FIGS. 2 and 3, the second conductive element 12 has a central opening 12C in and end surface 12D thereof. When the antenna is assembled, the end surfaces 12D and 13E are approximately coplanar. A connection pin 11C of the first conductive element 11 (see also FIG. 1) extends axially through the central openings 12C and 13G of the respective coplanar surfaces 12D and 13E. This is shown in FIGS. 5-7.

Referring again to FIG. 1, a disk-shaped dielectric cover 14 covers respective axial end surfaces 11B and 13B of the first conductive element 11 and the dielectric core 13. These surfaces 11B and 13B are approximately coplanar when the antenna is assembled. The assembled antenna is shown in FIG. 5 (inverted relative to FIG. 1), with a first axial end defined by the end surface 12D of the second conductive element 12, and a second axial end defined by the dielectric cover 14. The connection pin 11C of the first conductive element 11 extends axially beyond the end surface 12D to permit external connection. Radially outwardly facing, axially aligned cylindrical surfaces 12A and 13A of the second conductive element 12 and the dielectric core 13, respectively, together with the radially outwardly facing cylindrical surface of the cover 14, extend between the two axial ends of the assembled antenna. The constituent components 11-14 of the antenna are secured together by a suitable bonding agent, such as a low temperature thermal bonding film, in some embodiments.

All of the aforementioned tapered surfaces 11A, 12B, 13C and 13D taper radially outwardly as they extend axially toward the dielectric cover 14. As seen in the various FIGS. 1-8, the radially outwardly facing tapered surface 13C extends from the annular end surface 13E to the radially outwardly facing cylindrical surface 13A of the dielectric core 13. The radially inwardly facing tapered surface 13D extends from the annular end surface 13B to the annular end surface 13E of the core 13. Tapered surface 11A extends from the end surface 11B to an axially facing annular surface 11D that surrounds the connection pin 11C of the conductive element 11. Tapered surface 12B extends from the annular end surface 12D to a circumferentially extending edge 12E of the annular conductive element 12. Surfaces 13C and 12B are mutually conformal surfaces having approximately the same contour, such that surface 13C seats on surface 12B. Surfaces 11A and 13D are mutually conformal surfaces having approximately the same contour, such that surface 11A seats on surface 13D.

The end surface 13E of the core 13 is received in the opening 12C of the conductive element 12, and the surface 11D of the conductive element 11 is received in the opening 13G of the core 13. The surfaces 13E, 11D and 12D are approximately coplanar when the antenna is assembled. FIGS. 5-7 show this arrangement, and provide further illustration of the connection pin 11C extending through the openings 12C and 13G in the coplanar end surfaces 12D and 13E. FIGS. 6 and 7 show details of the connection pin 11C, and the coplanar surfaces 11D/12D/13E. In some embodiments, these features are cooperable with a conventional SMA connector (for example, a commercially available Huber Suhner 23_SMA-50-0-167/199_NE connector) that mates the antenna to a coaxial cable. FIG. 6 shows example radial dimensions of the pin 11C and the coplanar surfaces 11D/13E for mating to a conventional SMA connector. The conductive element 12 includes a hole pattern surrounding the central opening 12C in the surface 12D (see FIG. 3) and configured to match the mounting hole pattern of a conventional SMA connector.

In some embodiments, the connection pin 11C has a shaft portion 11E as shown in FIGS. 6 and 7. The shaft portion 11E is approximately 36 mils in diameter (see FIG. 7). It extends 73.2 mils axially beyond the coplanar surfaces 11D/12D/13E, and then extends axially another 15 mils while tapering radially inwardly at 11F to reach a diameter of 15 mils at its axial end 11G.

In some embodiments, surface 11A has a contour that corresponds to a segment of the curve $$x = 1.5\hat{}((-y/(30/11))\hat{}(0.75)) - 0.395$$

and surface 12B has a contour that corresponds to a segment of the curve $$x = 1.5\hat{}((-y/(15/100))\hat{}(0.4)) + 1$$

and surface 13D has a contour that corresponds to a segment of the curve $$x = 1.5\hat{}((-y/(30/11))\hat{}(0.75)) - 0.3215$$

and surface 13C has a contour that corresponds to a segment of the curve $$x = 1.5\hat{}((-y/(15/100))\hat{}(0.4)) + 0.9365.$$

Using the foregoing equations, the respectively corresponding surfaces are defined as surfaces of revolution about the central axis 10. A surface of revolution is constructed from a segment of a curve (or a line) that lies in the same plane as axis 10. Each point of the curve or line segment is revolved 360 degrees about the axis 10 in a plane that contains that point and is perpendicular to the axis 10. In the equations above, the axis 10 corresponds to the y variable. The coplanar surfaces 11D/12D/13E are located axially at y=0. The x variable corresponds to an axis (not shown) perpendicular to the central axis 10 and coplanar with y=0.

For each pair of cooperating conformal surfaces 11A/13D and 12B/13C, the corresponding pair of curves defined by the equations above have the same shape, and differ only by an offset that provides a radial space of approximately 2.5 mil between the pair of conformal surfaces, for insertion of the bonding agent during assembly. The equations above are provided according to units of millimeters for computational convenience, while all physical dimensions defined herein are provided in units of mils, for mechanical and manufacturing convenience. Conversion between millimeters and mils is of course straightforward. It will be noted in general that all of the surfaces illustrated in the coaxial arrangement of FIG. 1 may be termed surfaces of revolution, because all can be generated by revolution of a curve segment or line segment about the axis 10 as described above.

Figure 8:
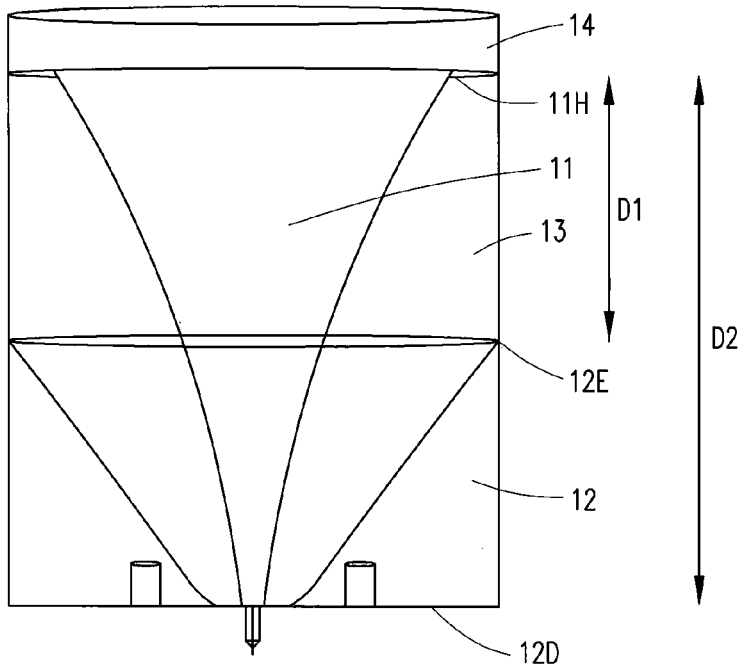
FIG. 8 illustrates components of the assembled antenna that are hidden in FIG. 5.

Referring particularly to FIGS. 1 and 8, a circumferentially extending edge 11H, where the surfaces 11A and 11B adjoin, is separated from the surface 12D by an axial distance (D2 in FIG. 8) equal to one-half of a guided wavelength at the lowest frequency of operation. This allows the antenna to radiate an omni-directional pattern at the lowest frequency of operation in a dipole-like fashion. This dimension will thus determine the lowest frequency in the antenna's bandwidth. The edge 11H is separated from the edge 12E of the conductive element 12 by an axial distance (D1 in FIG. 8) equal to one-half of a guided wavelength at the center frequency of operation. This allows the antenna to radiate its maximal horizontal (when the axis 10 is oriented vertically) gain at the center of the operational bandwidth.

The aforementioned guided wavelength is the free-space signal wavelength divided by the square root of the dielectric constant of the core 13. In some embodiments, the core 13 is a constructed of teflon. This helps to provide minimal wave reflections at the boundary between the antenna and the aforementioned SMA connector/coaxial cable. The teflon is low-loss, easily machined, and structurally rigid. In some embodiments, the cover 14 is also constructed of teflon. This provides a desirable impedance bandwidth for the antenna by smoothing wave transitions from the edge 11H into free space. FIGS. 1, 5 and 8 show that the dielectric cover 14 axially covers the end surface 11B of conductive element 11. FIGS. 1 and 6-8 show that the dielectric core 13 radially surrounds the conductive element 11 from edge 11H to connector pin 11C. The core 13 is thus interposed both radially and axially between the conductive elements 11 and 12. As shown in FIG. 7, the conductive elements 11 and 12 are, in some embodiments, constructed of an aluminum alloy, for example, the alloy commonly known as aluminum 6061.

The exponential tapers of the surfaces 11A and 12B on the conductive elements 11 and 12 provide ultra-wide impedance bandwidth. Notably, the exponential curves of the foregoing equations for surfaces 11A and 12B define the surfaces to have contours (shapes) that differ from one another. These differently shaped (i.e., mutually non-conformal) surfaces 11A and 12B overlap one another both radially and axially (see FIGS. 1 and 8), and their respective contours are designed for cooperation to provide phase distortion correction by causing the lowest frequency information, the mid-band frequency information, and the highest frequency information to arrive at their destination (whether transmitting to a remote receiver, or receiving at the antenna's cable connection) at approximately the same time.

Referring again to FIGS. 1 and 5, in some embodiments for UWB operation, each of the outer cylindrical surfaces 12A and 13A has a 590.5 mil axial dimension, the dielectric cover 14 has a 125 mil axial dimension, and the overall cylindrically shaped assembly has a 1095.6 mil outer diameter.

Considering again the aforementioned prior art planar UWB monopole, that antenna's radiation pattern has poor radial symmetry and predictability with frequency variation, making it difficult to characterize in multi-system environments. An antenna as described above according to the present work produces a dipole pattern that is symmetric to all equidistant users on its horizon at all frequencies in its bandwidth. This is helpful, for example, in communicating similar powers to all users in a LAN.

One known planar UWB monopole design is reputed to provide low dispersion performance through good group delay flatness. Experimental results obtained for that particular planar UWB monopole design show that it has 7.5 dB more dispersion loss, for an 8 GHz wide BPSK modulated signal, than does an antenna as described above according to the present work.

Looking at transient transmit and receive UWB signals overlapped in time, an antenna as described above according to the present work observably tracks phase changes of the transmit signal, while the planar UWB monopole does not.

Due to constraints of physics, an antenna as described above according to the present work cannot achieve both dispersion-free data transfer and maximal omni-directional gain at all frequencies. Accordingly, in embodiments of the present work such as described above, the antenna construction is designed such that the maximum omni-directional horizontal gain is near the center of the UWB band (6.85 GHz). This enables maximum signal power to be transmitted at the maximum RF power for direct-sequence spread spectrum signals that use the entire UWB bandwidth simultaneously. For other narrow-band signals in the UWB bandwidth, dispersion and gain consistency over the UWB band have minimal impact on operation.

Although both the planar UWB monopole and the present work provide UWB performance, experimental results show that the present work achieves, over the UWB range (3.1-10.6 GHz), lower loss from impedance mismatch than does the planar UWB monopole.

Some embodiments of the antenna described above according to the present work provide an omni-directional, horizontal gain pattern over the UWB frequency range with nearly distortionless UWB data transmissions and a 2.5 maximum measured VSWR between 3.1-10.6 GHz. While beam scanning through frequency always occurs for distortionless antennas, the present work maintains an omni-directional horizontal gain pattern throughout the UWB spectrum. The beam scanning occurs through frequency in the latitudinal (elevational) plane. Although this alters the magnitude of the antenna's horizontal gain such that maximal omni-directional horizontal gains are not achieved, nevertheless, useful omni-directional horizontal gains are provided, with nearly distortion free performance.

Although example embodiments of the present work are described above in detail, this does not limit the scope of the present work, which can be practiced in a variety of embodiments.

What is claimed is:

1. An antenna for producing an omni-directional pattern and using all frequencies of a frequency range simultaneously, comprising:

first and second electrically conductive elements disposed coaxially relative to a central axis;

said first element having a first surface of revolution about said axis, said first surface of revolution tapering radially outwardly while extending axially away from said second element to terminate at a first axial end of said first element;

said second element having a second surface of revolution about said axis, said second surface of revolution tapering radially outwardly while extending axially toward said first element to terminate at a first axial end of said second element, and said second surface of revolution overlapping said first surface of revolution radially and axially; and said second element having a third surface of revolution about said axis that extends radially outwardly as far as said second surface of revolution;

wherein said second and third surfaces of revolution have respectively different shapes.

2. The antenna of claim 1, wherein said first surface of revolution terminates to define a circumferentially extending edge at said first axial end of said first element, and further including a dielectric cover disposed axially adjacent said first axial end of said first element and axially covering said edge to smooth wave transitions from said edge into free space.

3. The antenna of claim 1, including an annular dielectric core radially surrounding said axis and having fourth and fifth surfaces of revolution about said axis, said dielectric core interposed axially and radially between said first and second elements with said fourth and fifth surfaces of revolution respectively in conformal contact with said first and second surfaces of revolution.

4. The antenna of claim 1, wherein said first element has a fourth, planar surface of revolution about said axis, said fourth surface of revolution facing away from said second element and adjoining said first surface of revolution to define said first axial end of said first element, wherein said third surface of revolution is a planar surface facing away from said first element and defining a second axial end of said second element, wherein said axis traverses said fourth surface of revolution, and wherein said second element is annular with a central opening therein that radially surrounds said axis.

5. An antenna for producing an omni-directional pattern and using all frequencies of a frequency range simultaneously, comprising:

first and second electrically conductive elements disposed coaxially relative to a central axis;

said first element having a first surface of revolution about said axis, said first surface of revolution tapering radially outwardly while extending axially away from said second element to terminate at a first axial end of said first element;

said second element having second and third surfaces of revolution about said axis, said second surface of revolution tapering radially outwardly while extending axially toward said first element to terminate at a first axial end of said second element, said second surface of revolution overlapping said first surface of revolution radially and axially, and said third surface of revolution facing away from said first element and defining a second axial end of said second element; and a core element that is fixed to and interposed axially between said first and second elements and establishes first and second axial distances relative to said first and second elements;

wherein said first axial distance is a distance between said first axial end of said first element and said first axial end of said second element, and bears a predetermined relationship to a wavelength associated with a center frequency of said frequency range, and wherein said second axial distance is a distance between said first axial end of said first element and said second axial end of said second element, and bears a predetermined relationship to a wavelength associated with a lowest frequency of said frequency range.

6. The antenna of claim 5, wherein said first and second surfaces of revolution are mutually non-conformal.

7. The antenna of claim 5, wherein said first surface of revolution terminates to define a circumferentially extending edge at said first axial end of said first element, and further including a dielectric cover disposed axially adjacent said first axial end of said first element and axially covering said edge to smooth wave transitions from said edge into free space.

8. The antenna of claim 5, wherein said core element is an annular dielectric core radially surrounding said axis and having fourth and fifth surfaces of revolution about said axis, said dielectric core interposed axially and radially between said first and second elements with said fourth and fifth surfaces of revolution respectively in conformal contact with said first and second surfaces of revolution.

9. The antenna of claim 5, wherein said first element has a fourth, planar surface of revolution about said axis, said fourth surface of revolution facing away from said second element and adjoining said first surface of revolution to define said first axial end of said first element, wherein said axis traverses said fourth surface of revolution, and wherein said second element is annular with a central opening therein that radially surrounds said axis.

10. An antenna for producing an omni-directional pattern and using all frequencies of a frequency range simultaneously, comprising:

first and second electrically conductive elements disposed coaxially relative to a central axis;

said first element having a first surface of revolution about said axis, said first surface of revolution tapering radially outwardly while extending axially away from said second element to terminate at a first axial end of said first element;

said second element having a second surface of revolution about said axis, said second surface of revolution tapering radially outwardly while extending axially toward said first element to terminate at a first axial end of said second element, and said second surface of revolution overlapping said first surface of revolution radially and axially; and an annular dielectric core radially surrounding said axis and having third and fourth surfaces of revolution about said axis, said dielectric core interposed axially and radially between said first and second elements with said third and fourth surfaces of revolution respectively in conformal contact with said first and second surfaces of revolution.

11. The antenna of claim 10, wherein said first surface of revolution terminates to define a circumferentially extending edge at said first axial end of said first element, and further including a dielectric cover disposed axially adjacent said first axial end of said first element and axially covering said edge to smooth wave transitions from said edge into free space.

12. The antenna of claim 11, wherein said dielectric core radially surrounds said edge.

13. The antenna of claim 10, wherein said first and second surfaces of revolution are mutually non-conformal.

14. The antenna of claim 10, wherein said first element has a third surface of revolution about said axis, said third surface of revolution facing away from said second element and adjoining said first surface of revolution to define said first axial end of said first element, wherein said second element has a fourth surface of revolution about said axis, said fourth surface of revolution facing away from said first element and defining a second axial end of said second element, wherein said axis traverses said third surface of revolution, and wherein said second element is annular with a central opening therein that radially surrounds said axis.

15. The antenna of claim 10, wherein said dielectric core is constructed of teflon.

16. An antenna for producing an omni-directional pattern and using all frequencies of a frequency range simultaneously, comprising:

first and second electrically conductive elements disposed coaxially relative to a central axis;

said first element having a first surface of revolution about said axis, said first surface of revolution tapering radially outwardly while extending axially away from said second element to terminate at a first axial end of said first element and define a circumferentially extending edge at said first axial end of said first element;

said second element having a second surface of revolution about said axis, said second surface of revolution tapering radially outwardly while extending axially toward said first element to terminate at a first axial end of said second element, said second surface of revolution overlapping said first surface of revolution radially and axially;

a dielectric core element fixed to and interposed axially between said first and second elements and radially surrounding said edge; and a dielectric cover disposed axially adjacent said first axial end of said first element, said dielectric cover seated on said dielectric core and axially covering said edge to smooth wave transitions from said edge into free space.

17. The antenna of claim 16, wherein said first and second surfaces of revolution are mutually non-conformal.

18. The antenna of claim 16, wherein said first and second elements are constructed of an aluminum alloy, said dielectric cover is constructed of teflon, and said frequency range is UWB.

19. The antenna of claim 16, wherein said first element has a third, planar surface of revolution about said axis, said third surface of revolution adjoining said first surface of revolution at said edge and defining said first axial end of said first element, wherein said second element has a fourth, planar surface of revolution about said axis, said fourth surface of revolution facing away from said first element and defining a second axial end of said second element, wherein said axis traverses said third surface of revolution, and wherein said second element is annular with a central opening therein that radially surrounds said axis.

* * * * *